US012186799B1

(12) United States Patent
Feng et al.

(10) Patent No.: US 12,186,799 B1
(45) Date of Patent: Jan. 7, 2025

(54) INJECTION SYSTEM FOR DIE CASTING MACHINE

(71) Applicant: Ningbo LK Technology Co., Ltd., Ningbo (CN)

(72) Inventors: Guangming Feng, Ningbo (CN); Yunxiang Wang, Ningbo (CN); Ruiting Zhang, Ningbo (CN); Binyao Gao, Ningbo (CN); Guangping Ding, Ningbo (CN); Anqing Lv, Ningbo (CN); Jiangpin Hu, Ningbo (CN); Yagang Liu, Ningbo (CN); Xiaofeng Zhong, Ningbo (CN)

( * ) Notice: Subject to any disclaimer, the term of this patent is extended or adjusted under 35 U.S.C. 154(b) by 0 days.

(21) Appl. No.: 18/733,502

(22) Filed: Jun. 4, 2024

(30) Foreign Application Priority Data

Jan. 29, 2024 (CN) ..... 202410116264.7

(51) Int. Cl.
*B22D 17/20* (2006.01)

(52) U.S. Cl.
CPC ..... *B22D 17/203* (2013.01)

(58) Field of Classification Search
CPC ..... B22D 17/203
See application file for complete search history.

(56) References Cited

U.S. PATENT DOCUMENTS

| | | | |
|---|---|---|---|
| 2010/0000699 | A1 | 1/2010 | Uchida et al. |
| 2022/0168937 | A1 | 6/2022 | Fujioka et al. |

FOREIGN PATENT DOCUMENTS

| | | | |
|---|---|---|---|
| CN | 1857831 | A | 11/2006 |
| CN | 108679016 | A | 10/2018 |
| CN | 115889731 | A | 4/2023 |
| CN | 116851706 | A | 10/2023 |
| JP | H06154990 | A | 6/1994 |
| JP | 2001025857 | A | 1/2001 |
| JP | 2009226448 | A | 10/2009 |
| WO | 2022176899 | A1 | 8/2022 |

*Primary Examiner* — Kevin P Kerns
*Assistant Examiner* — Steven S Ha

(57) ABSTRACT

The present application discloses an injection system for a die casting machine, which includes an accumulator, an injection cylinder, a pressurization cylinder and a valve module connected via an oil pipeline; in a slow injection phase of the injection cylinder, the valve module is adapted for dynamic switching between a phase of an oil pump of the oil pipeline supplying oil alone and a phase of the oil pump and the accumulator jointly supplying oil; in a fast injection phase, a braking phase, a tracking phase and a pressurization injection phase, the oil pump of the oil pipeline and an oil tank form a first A-type half-bridge structure.

5 Claims, 11 Drawing Sheets

INJECTION SYSTEM FOR DIE CASTING MACHINE

CROSS-REFERENCE TO RELATED APPLICATIONS

The present application claims priority to Chinese Patent Application No. 202410116264.7, filed Jan. 29, 2024, the entire disclosure of which is incorporated herein by reference.

TECHNICAL FIELD

The present application relates to the technical field of metal die casting, and particularly to an injection system for a die casting machine.

BACKGROUND

A die casting machine is a machine used for pressure casting, commonly used in the production and processing of automotive components, etc. The Die casting machine under the action of pressure can inject the molten metal hydraulic into the mould for cooling molding, after opening the mould, solid metal castings can be obtained.

The injection actions of the existing cold chamber die casting machine is divided into three processes: a slow injection, a fast injection, and a pressurization injection. In the completion of the fast injection and before ready to carry out the pressurization injection, the injection cylinder needs to be braked. After the die casting machine completes the die casting action, a pressure relief process, a tracking process, and a hammer return process are also required to return to the initial position.

However, an injection system of the existing die casting machine may have the following conditions when performing the above processes:

(1) A start-up shock may occur during a slow start-up phase with poor precision control.

(2) Overshooting of speed may occur in the fast injection phase.

(3) Oil may be discharged excessively or insufficiently in the pressurization injection phase, thereby resulting in poor precision of the pressurization.

(4) Slow braking may occur in the braking phase, resulting in a poor braking.

(5) In the tracking phase, there may be an uncontrolled hammer head, thereby resulting in the loss of control of the tracking.

Based on the above, there is an urgent need to improve the injection system of the existing die casting machine.

SUMMARY

One of the objects of the present application is to provide an injection system capable of solving at least one of the above mentioned deficiencies in the background art.

In order to achieve at least one of the above objects, the present application employs the following technical solutions:

an injection system for a die casting machine, including an accumulator, an injection cylinder, a pressurization cylinder and a valve module connected via an oil pipeline;

in a slow injection phase of the injection cylinder, the valve module is adapted for dynamic switching between a phase of an oil pump of the oil pipeline supplying oil alone and a phase of the oil pump and the accumulator jointly supplying oil;

in a fast injection phase, a braking phase and a tracking phase, the valve module is configured to make a rod chamber of the injection cylinder to be conductive with the oil pump of the oil pipeline and an oil tank, to form a first A-type half-bridge structure; and in a pressurization injection phase, the valve module is configured to make a rod chamber of the pressurization cylinder to be conductive with the oil pump of the oil pipeline and the oil tank to form a second A-type half-bridge structure.

In an embodiment, the valve module includes a switching valve V5, a switching valve V8, a servo valve V9 and an un-directional valve V11 and an un-directional valve V13;

an output end of the oil pump is connected to the rod chamber of the injection cylinder via the un-directional valve V11 and the servo valve V9 connected in series in sequence to form a first oil pipeline;

the output of the oil pump is connected to a non-rod chamber of the injection cylinder via the un-directional valve V11, the un-directional valve V13, the switching valve V8 and the switching valve V5 connected in series in sequence to form a third oil pipeline; and in the phase of the oil pump supplying oil alone in the slow injection phase, the oil pump supplies oil to the non-rod chamber of the injection cylinder via the third oil pipeline that is conductive, and the first oil pipeline forms a differential loop with the third oil pipeline.

In an embodiment, the valve module further includes a switching valve V4;

the accumulator is connected to the non-rod chamber of the injection cylinder via the switching valve V4 and the switching valve V5 connected in series in sequence to form a fourth oil pipeline; and in the phase of the oil pump and the accumulator jointly supplying oil in the slow injection phase, the accumulator supplies oil to the non-rod chamber of the injection cylinder via the fourth oil pipeline that is conductive on a basis of the oil pump supplying oil alone.

In an embodiment, the valve module further includes a servo valve V7;

the oil tank is connected to the rod chamber of the injection cylinder via the servo valve V7 to form a fifth oil pipeline;

in the fast injection phase and the braking phase, the accumulator supplies oil to the non-rod chamber of the injection cylinder via the conductive fourth oil pipeline, and the pressure oil in the rod chamber of the injection cylinder flows back to the oil tank along the fifth oil pipeline that is conductive; and the first oil pipeline and the fifth oil pipeline are conducted to form a third A-type half-bridge structure, and opening degrees of the servo valve V7 and the servo valve V9 are controlled to regulate an injection speed of the injection cylinder.

In an embodiment, the valve module further includes a switching valve V12;

the output of the oil pump is connected to the accumulator via the switching valve V12 to form a second oil pipeline;

in the tracking phase, the oil pump and the accumulator supply oil to the non-rod chamber of the injection cylinder via a conductive third oil pipeline and the conductive fourth oil pipeline, respectively; the oil pump further replenishes the accumulator with oil via the second oil pipeline; and the pressure oil in the rod chamber of the injection cylinder flows back to the oil tank along the fifth oil pipeline; and the first oil pipeline and the fifth oil pipeline are conducted to form a fourth A-type half-bridge structure, and opening degrees of the servo valve V7 and the servo valve V9 are controlled to regulate the injection speed of the injection cylinder.

In an embodiment, the valve module further includes a switching valve V6;

the accumulator is connected to a non-rod chamber of the pressurization cylinder via the switching valve V4 to form a sixth oil pipeline;

the oil tank is connected to the rod chamber of the pressurization cylinder via the servo valve V7 and the switching valve V6 connected in series in sequence to form a seventh oil pipeline;

the output of the oil pump is connected to the rod chamber of the pressurization cylinder via the un-directional valve V11, the servo valve V9 and the switching valve V6 connected in series in turn to form an eighth oil pipeline;

in the pressurization injection phase, the accumulator supplies oil to the non-rod chamber of the pressurization cylinder via the sixth oil pipeline that is conductive; the pressure oil in the rod chamber of the pressurization cylinder and the rod chamber of the injection cylinder flows back to the oil tank along the seventh oil pipeline and the fifth oil pipeline that are conducive respectively; and the eighth oil pipeline and the seventh oil pipeline are conducted to form a fifth A-type half-bridge structure, and opening degrees of the servo valve V9 and the servo valve V7 are controlled to regulate a pressurized pressure of the pressurization cylinder.

In an embodiment, when pressure relief is carried out after a completion of the pressurization injection phase, oil is stopped supplying from the accumulator to the non-rod chamber of the pressurization cylinder and the opening degree of the servo valve V9 is increased and the opening degree of the servo valve V7 is decreased to allow the oil pump to supply oil to the rod chamber of the pressurization cylinder via the eighth oil pipeline that is conductive, thereby the pressurization cylinder retracting to make the pressure oil in the non-rod chamber of the pressurization cylinder to flow back to the accumulator along the conductive sixth oil pipeline.

In an embodiment, the valve module further includes a switching valve V10;

the oil tank is connected to the non-rod chamber of the pressurization cylinder via the switching valve V10 to form a ninth oil pipeline; and the oil tank is connected to the non-rod chamber of the injection cylinder via the switching valve V10 and the switching valve V5 connected in series in sequence to form a tenth oil pipeline;

in a hammer return phase after a completion of the tracking phase, the oil pump supplies oil to the rod chamber of the injection cylinder and the rod chamber of the pressurization cylinder via the first oil pipeline and the eighth oil pipeline that are conductive, respectively; and the non-rod chamber of the injection cylinder and the non-rod chamber of the pressurization cylinder make the pressure oil to flow back to the oil tank via the tenth oil pipeline and the ninth oil pipeline that are conductive, respectively.

In an embodiment, the valve module further includes a servo valve V14 and a servo valve V15;

the accumulator is connected to the non-rod chamber of the pressurization cylinder via the switching valve V4 to form a sixth oil pipeline;

the accumulator is connected to the rod chamber of the pressurization cylinder via the servo valve V14 to form an eleventh oil pipeline;

the oil tank is connected to the rod chamber of the pressurization cylinder via the servo valve V15 to form a twelfth oil pipeline;

in the pressurization injection phase, the accumulator supplies oil to the non-rod chamber of the pressurization cylinder via the conductive sixth oil pipeline; the pressure oil in the rod chamber of the injection cylinder flows back to the oil tank along the conductive fifth oil pipeline; and the eleventh oil pipeline and the twelfth oil pipeline are conducted to form a sixth A-type half-bridge structure, and opening degrees of the servo valves V14 and V15 are controlled to regulate the pressurized pressure of the pressurization cylinder.

In an embodiment, when pressure relief is carried out after the completion of the pressurization injection phase, the fifth oil pipeline and the twelfth oil pipeline are cut off, and the sixth oil pipeline and the eleventh oil pipeline are conductive, but the oil is stopped supplying from the accumulator to the sixth oil pipeline, to make the accumulator to supply oil to the rod chamber of the pressurization cylinder via the eleventh oil pipeline, thereby the pressurization cylinder retracting, to make the pressure oil in the non-rod chamber of the pressurization cylinder to flow back to the accumulator along the conductive sixth oil pipeline.

In an embodiment, the valve module further includes a switching valve V10;

the oil tank is connected to the non-rod chamber of the pressurization cylinder via the switching valve V10 to form a ninth oil pipeline;

the oil tank is connected to the non-rod chamber of the injection cylinder via the switching valve V10 and the switching valve V5 connected in series in sequence to form a tenth oil pipeline;

the oil pump is connected to the rod chamber of the pressurization cylinder via the switching valve V12 and the servo valve V14 connected in series in sequence to form a thirteenth oil pipeline;

in a hammer return phase after a completion of the tracking phase, the oil pump supplies oil to the rod chamber of the injection cylinder and the rod chamber of the pressurization cylinder via the first oil pipeline and the thirteenth oil pipeline that are conductive, respectively; and the non-rod chamber of the injection cylinder and the non-rod chamber of the pressurization cylinder make the pressure oil flow back to the oil tank via the tenth oil pipeline and the ninth oil pipeline that are conductive, respectively.

Compared with the related art, the beneficial effects of the present application are:

(1) In the slow injection phase, a phase of an oil pump supplying oil alone is added; by the combination of the phase of the oil pump supplying oil alone and the phase of the oil pump and accumulator joint supplying oil, the oil consumption of the accumulator can be effectively reduced and the dynamic injection force of the injection cylinder can be improved.

(2) The oil pipeline is designed to be the A-type half-bridge structure, which can control the speed of the injection cylinder and the pressurized pressure of the pressurization cylinder. Compared with the traditional method, the speed overshooting can be effectively avoided or reduced, and the pressure stability and control precision of the pressurization injection can also be ensured.

DETAILED DESCRIPTION OF THE EMBODIMENTS

Figure 1:
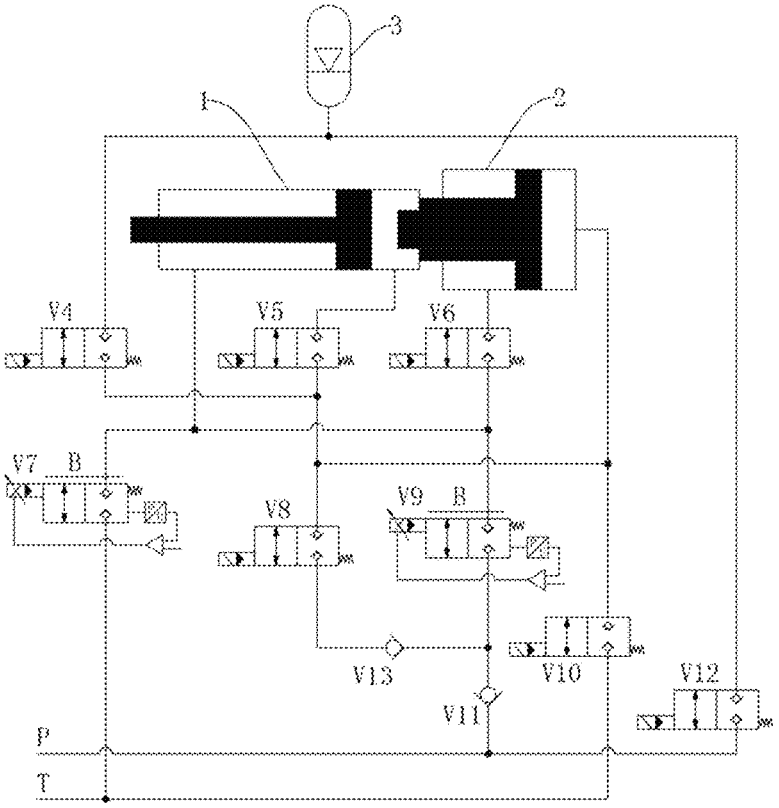
FIG. 1 is a schematic structural diagram of an oil pipeline of an injection system according to a first embodiment of the present application.

In the following, the present application is further described in relation to specific embodiments, and it is to be noted that without confliction, new embodiments may be formed by combining any of the embodiments described hereinafter or any of the technical features.

In the description of the present application, it is to be noted that for orientation words, such as the terms "centre", "transverse", "longitudinal", "length", "width", "thickness", "up", "down", "front", "back", "left", "right", "vertical", "horizontal", "top", "bottom", "inner", "outside", "clockwise", "counterclockwise", etc. indicative of orientation and positional relationships are based on the orientation or positional relationships shown in the accompanying drawings, and are merely for the purpose of facilitating the narration of the present application and simplifying the description, and are not intended to indicate or imply that the referred devices or elements must have a particular orientation, be constructed and operated in a particular orientation, and are not to be construed as limiting the specific scope of the present application.

It should be noted that the terms "first", "second", etc. in the specification and claims of the present application are used to distinguish similar objects, and need not be used to describe a particular order or sequence.

The terms "comprising" and "having" in the specification and claims of the present application, and any variations thereof, are intended to cover non-exclusive encompassing, e.g., processes, methods, systems, products, or equipment comprising a series of steps or units need not be limited to those steps or units that are clearly listed, but may include other steps or units that are not clearly listed or are inherent to those processes, methods, products or equipment.

The present application provides an injection system for a die casting machine, as shown in FIGS. 1 to 22, a preferred embodiment includes an accumulator 3, an injection cylinder 1, a pressurization cylinder 2, and a valve module connected via an oil pipeline. In a slow injection phase of the injection cylinder 1, the valve module is adapted for dynamic switching between a phase of an oil pump of the oil pipeline supplying oil alone and a phase of the oil pump and the accumulator 3 jointly supplying oil. In a fast injection phase, a braking phase and a tracking phase, the valve module is configured to make a rod chamber 1 of the injection cylinder to be conductive with the oil pump of the oil pipeline and an oil tank, to form an A-type half-bridge structure; and in a pressurization injection phase, the valve module is configured to make a rod chamber of the pressurization cylinder 2 to be conductive with the oil pump of the oil pipeline and the oil tank to form an A-type half-bridge structure.

It should be known that in the conventional injection system, the injection speed control mode of the injection cylinder 1 is relatively single; generally speaking, in order to ensure the stable operation of the injection cylinder 1, the injection cylinder 1 is supplied with oil by the accumulator 3 in the slow injection phase. Since the duration of the slow injection phase is relatively long, and the accumulator 3 is required for power output in a number of subsequent injection phases, if the oil consumption of the accumulator 3 in the slow injection phase is large, it will affect the subsequent injection process.

Therefore, in this embodiment, the injection cylinder 1, the accumulator 3, and the oil pump are connected to the oil pipeline via the valve module, so as to enable three oil supply modes of the injection cylinder 1 in the slow injection phase. In the first oil supply mode, the injection cylinder 1 is directly supplied with oil via the oil pump. In the second oil supply mode, the injection cylinder 1 is directly supplied with oil via the accumulator 3. In the third oil supply mode, the injection cylinder 1 is simultaneously supplied with oil via the oil pump and the accumulator 3. In order to further ensure that the injection process is carried out in a stable manner, the oil supply mode in the slow injection phase in this embodiment preferably adopts a combination of the first oil supply mode and the third oil supply mode described above. That is, when the requirement for the speed is not high, the oil is supplied with the first oil supply mode, and when the requirement for the speed increases, the oil can be supplied with the third oil supply mode. The switching between the first oil supply mode and the third oil supply mode can be controlled via the valve module, so as to effectively reduce the oil consumption of the accumulator 3 and increase the dynamic injection force of the injection cylinder 1.

It should also be known that, when the conventional injection system carries out the fast injection phase, due to the role of inertia, the maximum speed that the injection cylinder 1 can reach is generally higher than a preset target speed, then it is reflected that a bump is produced in the speed curve, i.e., a high-speed overshoot. In the pressurization injection phase, because the response of the servo valve in the oil pipeline is always lagging behind the control cycle of the control system, which leads to insufficient or excessive oil displacement of the pressurization cylinder 2, thereby affecting the precision of the pressurized pressure. In the tracking phase, after the completion of the pressurization, due to the excessive pressure in the non-rod chamber of the injection cylinder 1 and insufficient oil in the rod chamber of the injection cylinder 1, the oil compressed in the non-rod chamber of the injection cylinder 1 pushes the hammer head forward during the mould opening process, resulting in the hammer head being uncontrolled, thereby causing the tracking to be out of control.

In the present embodiment, in the fast injection phase and the tracking phase, the rod chamber of the injection cylinder 1 can be conductive with the oil pump of the oil pipeline and the oil tank via the valve module to form an A-type half-bridge structure, and in the pressurization injection phase, the rod chamber of the pressurization cylinder 2 can be be conductive with the oil pump of the oil pipeline and the oil tank via the valve module to form an A-type half-bridge structure. The A-type half-bridge structure is a linkage control structure formed by linking two servo valves, which is capable of simultaneously controlling the injection speed and casting pressure of the cylinder, thereby improving the speed control precision and pressure control precision of the injection, and greatly reducing the cost.

In the present application, there are a variety of specific oil pipeline structures of the injection system capable of realizing the above functions. In order to facilitate understanding, the following can be illustrated by two specific embodiments. Of course, the specific oil pipeline structures include, but are not limited to, the two embodiments described below. The thick solid line in FIGS. 2 to 10 and FIGS. 14 to 22 indicates the oil pipeline is conductive and the dashed line indicates that the oil pipeline is not conductive; the oil pump is represented by P and the oil tank is represented by T.

First Embodiment

As shown in FIGS. 1 to 10, the valve module includes switching valves V4, V5, V6, V8, V10, and V12, servo valves V7 and V9, and un-directional valves V11 and V13. An output end of the oil pump is connected to the rod chamber of the injection cylinder 1 via the un-directional valve V11 and the servo valve V9 connected in series in sequence, to form a first oil pipeline. The output end of the oil pump is connected to the accumulator 3 via the switching valve V12 to form a second oil pipeline. The output end of the oil pump is connected to the non-rod chamber of the injection cylinder 1 via the un-directional valve V11, the un-directional valve V13, the switching valve V8 and the switching valve V5 connected in series in sequence to form a third oil pipeline. The accumulator 3 is connected to the non-rod chamber of the injection cylinder 1 via the switching valve V4 and the switching valve V5 connected in series in sequence to form a fourth oil pipeline. The oil tank is connected to the rod chamber of the injection cylinder 1 via the servo valve V7 to form a fifth oil pipeline. The accumulator 3 is connected to the non-rod chamber of the pressurization cylinder 2 via the switching valve V4 to form a sixth oil pipeline. The oil tank is connected to the rod chamber of the pressurization cylinder 2 via the servo valve V7 and the switching valve V6 connected in series in sequence to form a seventh oil pipeline. The output end of the oil pump is connected to the rod chamber of the pressurization cylinder 2 via the un-directional valve V11, the servo valve V9 and the switching valve V6 connected in series in sequence to form a eighth oil pipeline. The oil tank is connected to the non-rod chamber of the pressurization cylinder 2 via the switching valve V10 to form a ninth oil pipeline; and the oil tank is connected to the non-rod chamber of the injection cylinder 1 via the switching valves V10 and V5 connected in series in sequence to form a tenth oil pipeline.

It should be appreciated that the function of the switching valve V12 is to control the oil pump to supply oil to the accumulator 3.

The oil in the accumulator 3 can enter the non-rod chamber of the pressurization cylinder 2 and the non-rod chamber of the injection cylinder 1 via the switching valves V4 and V5, respectively. Specifically, the function of the switching valve V5 is to allow the oil from the accumulator 3 to flow directly into the non-rod chamber of the injection cylinder 1 in the injection process. Compared to the traditional oil pipeline with multi-switching valves, the throttling loss can be reduced in the high-speed injection, to effectively improve the dynamic injection force of the injection cylinder 1, and the closure of the switching valve V5 can prevent the high-pressure oil from flowing out in pressurization injection phase, and the oil in the non-rod chamber of the injection cylinder 1 can be discharged in the hammer return phase.

The switching valve V4 is directly connected to the non-rod chamber of the pressurization cylinder 2, and the oil in the accumulator 3 enters the non-rod chamber of the pressurization cylinder 2 via the switching valve V4 in pressurization injection phase. The function of the switching valve V8 connected to the switching valve V5 is to make the oil in the rod chamber of the injection cylinder 1 after flowing through the servo valve V9 and the oil from the un-directional valves V11 and V13 together to flow through the switching valve V8 to form a differential connection in the slow injection phase.

The servo valve V9 and the switching valve V5 are connected to the non-rod chamber of the injection cylinder 1. In the slow injection phase, the servo valve V9 can control the oil return speed of the non-rod chamber of the injection cylinder 1. In the fast injection phase, the servo valve V9 and the servo valve V7 can intersect via the oil pipeline at a position where the rod chamber of the injection cylinder 1 is located to form an A-type half-bridge structure, to control the speed of fast injection. When the switching valve V6 is opened in the pressurization injection phase, the servo valve 9 and the servo valve V7 can also intersect via an oil pipeline at a position where the rod chamber of the pressurization cylinder 2 is located to form an A-type half-bridge structure, to control the pressurized pressure of the pressurization cylinder 2. Specifically, the switching valve V6 is connected to the rod chamber of the pressurization cylinder 2, for controlling whether the pressurization is started or not.

The switching valve V10 and the switching valve V5 connect the non-rod chamber of the pressurization cylinder 2 and the non-rod chamber of the injection cylinder 1 to the oil tank, respectively, to allow the oil from the non-rod chamber of the pressurization cylinder 2 and the non-rod chamber of the injection cylinder 1 to be discharged and to flow back to the oil tank when the hammer is returned.

The un-directional valve V11 serves to prevent backflow of hydraulic fluid caused by high pressure in the oil pipeline after the un-directional valve V11.

The entire injection process of the injection system of the present embodiment can be sequentially divided into an energy storage phase, a slow injection phase, a fast injection phase, a braking phase, a pressurization delay phase, a pressurization injection phase, a pressure relief phase, a tracking phase, and a hammer return phase. For the sake of understanding, the specific work process of each phase can be described in detail below.

Figure 2:
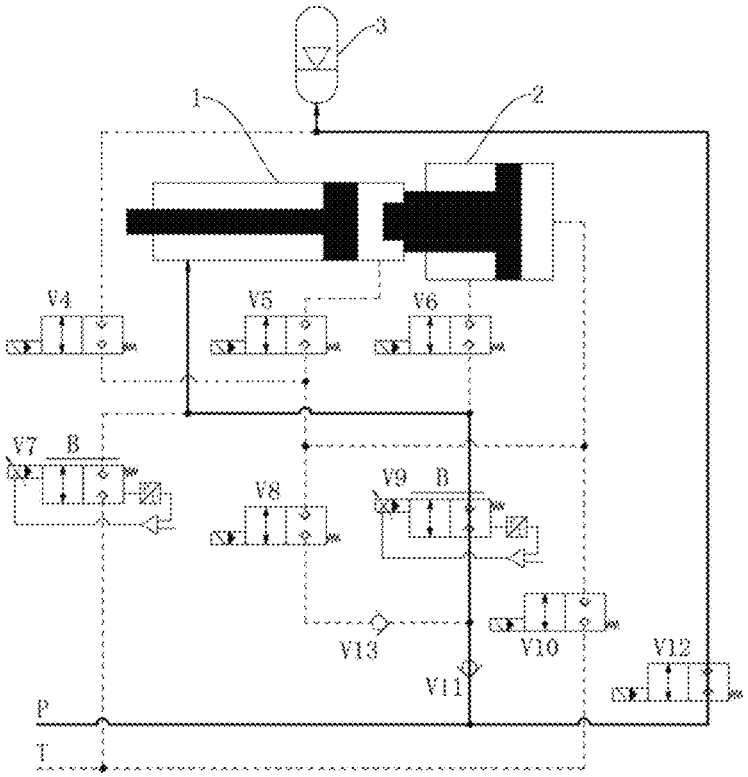
FIG. 2 is an equivalent schematic diagram of the oil pipeline in an energy storage phase according to the first embodiment of the present application.

First, in the energy storage phase, as shown in FIG. 2, the control system of the injection system can control the servo valve V9 and the switching valve V12 to be conductive, then the first oil pipeline and the second oil pipeline are in the conductive state, and then the oil pump can be started and supply oil to the rod chamber of the injection cylinder 1 for stamping via the conductive first oil pipeline, and can also supply oil to the accumulator 3 via the conductive second oil pipeline. By supplying oil to the rod chamber of the injection cylinder 1 to build up pressure before the slow injection phase is carried out, the start-up shock in the slow injection phase can be reduced or avoided.

Second, the slow injection phase includes a phase of an oil pump supplying oil alone and a phase of the oil pump and the accumulator 3 jointly supplying oil.

Figure 3:
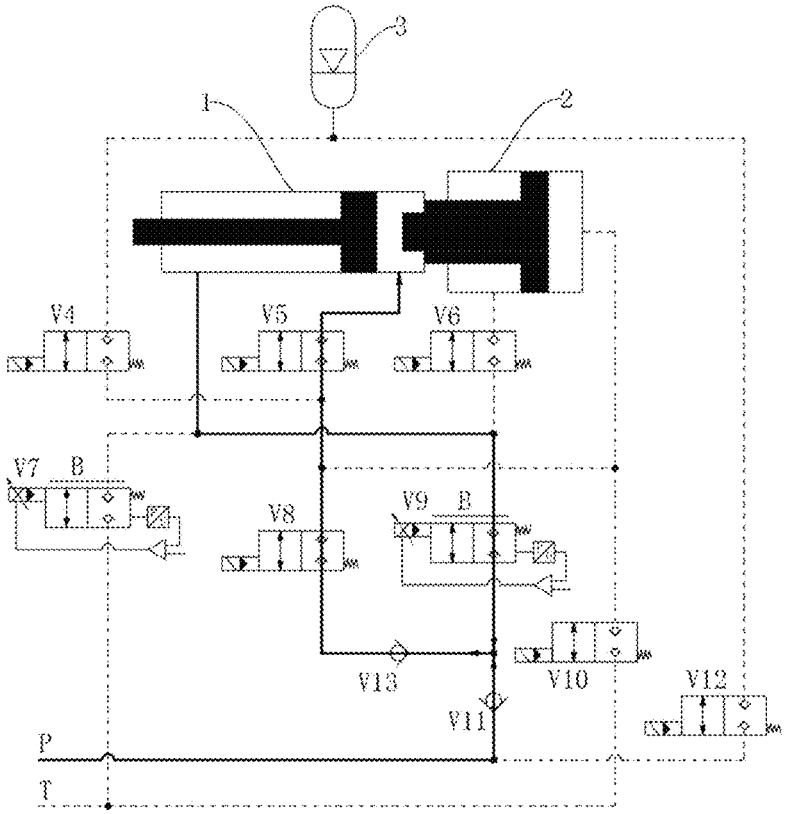
FIG. 3 is an equivalent schematic diagram of the oil pipeline when a slow injection phase is carried out alone by the oil pump according to the first embodiment of the present application.

(1) The phase of the oil pump supplying oil alone, as shown in FIG. 3, the switching valve V12 is closed after the completion of the energy storage phase, the servo valve V9 remains conductive, and the switching valves V5 and V8 are conducted. At this time, the first oil pipeline and the third oil pipeline are in the conductive state, and the first oil pipeline and the third oil pipeline intersect at the output end of the un-directional valve V11 to form a differential loop. That is, the oil pump supplies oil to the non-rod chamber of the injection cylinder 1 via the conductive third oil pipeline, and the pressure oil in the rod chamber of the injection cylinder 1 can flow into the non-rod chamber of the injection cylinder 1 along the servo valve 9 after flowing through the un-directional valve V13, the switching valve V5, and V8 in turn.

Figure 4:
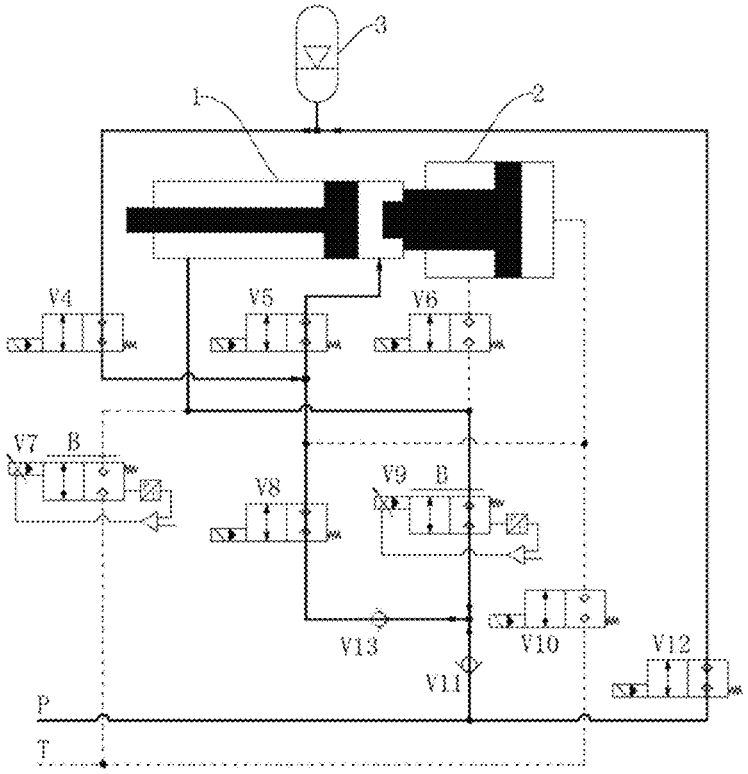
FIG. 4 is an equivalent schematic diagram of the oil pipeline when the slow injection phase is carried out by a collaboration of the oil pump and the accumulator according to the first embodiment of the present application.

(2) The phase of the oil pump and the accumulator 3 jointly supplying oil, as shown in FIG. 4, on the basis of the phase of oil pump supplying oil alone, the switching valve V4 and the switching valve V12 are conducted. At this time, the first oil pipeline, the second oil pipeline, the third oil pipeline and the fourth oil pipeline are all in the conductive state, and the first oil pipeline and the third oil pipeline intersect at the output end of the un-directional valve V11 to form a differential loop. That is, on the basis of the phase of the oil pump supplying oil alone, the accumulator 3 can supply oil to the non-rod chamber of the injection cylinder 1 via the conductive fourth oil pipeline, while the oil pump can replenish the accumulator 3 with oil via the conductive second oil pipeline.

It is to be understood that by adopting the differential control in the slow injection phase, while ensuring the stability of the slow injection, the speed of the slow injection can also be controlled by controlling the flow rate of the rod chamber of the injection cylinder 1 via the servo valve V9. Moreover, in the differential control, the pressure difference between before the servo valve V9 is opened and after the servo valve V9 is opened is smaller than that in the conventional separate outlet control, which makes the pressure gain of the servo valve V9 small, and thus improves the control precision of the injection cylinder 1. Moreover, since the pressure has already been built up in the rod chamber of the injection cylinder 1 during the energy storage phase before the start of the slow injection, the oil compressed in the rod chamber during the start of the slow injection is reduced, and the start-up shock can be avoided or reduced.

It is also be appreciated that in the actual injection process, the slow injection phase occupies a majority of strokes. In this embodiment, through the establishment of the differential loop, the flow rate required for the injection cylinder 1 in the slow injection phase can be smaller than the flow rate required for the traditional non-differential control, and the oil pump and the accumulator 3 jointly supplying oil can further reduce the amount of oil of the accumulator 3 supplied to the outside, then the volume of the accumulator 3 can be appropriately reduced.

Figure 5:
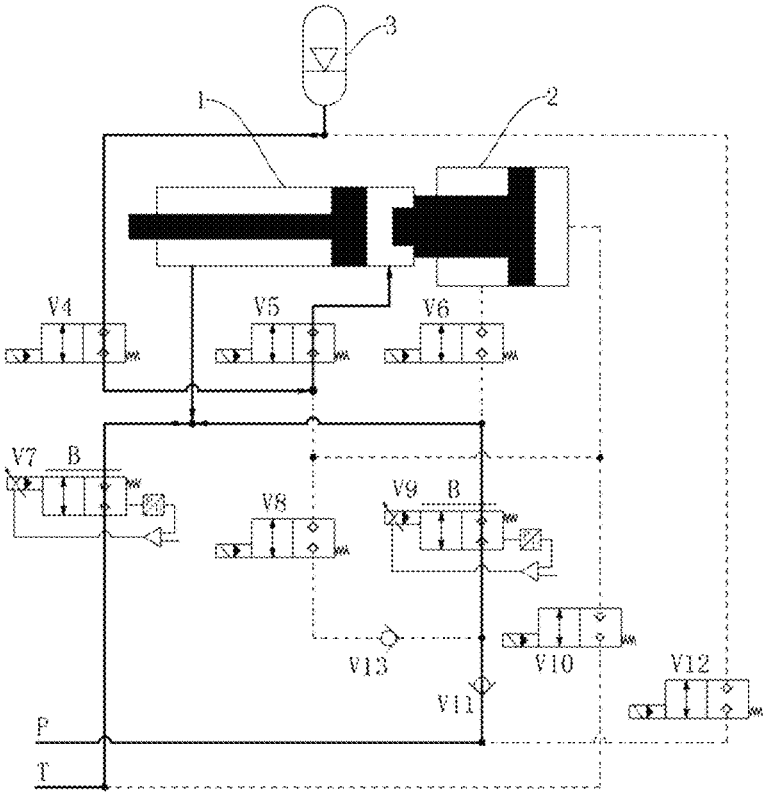
FIG. 5 is an equivalent schematic diagram of the oil pipeline in a fast injection phase and a braking phase according to the first embodiment of the present application.

Third, in the fast injection phase and the braking phase, as shown in FIG. 5, the servo valve V7 is opened, the switching valve V8 and the switching valve V12 are closed, and the switching valves V4 and V5 remain conductive; at this time, the first oil pipeline, the fourth oil pipeline, and the fifth oil pipeline are in the conductive state, and the first oil pipeline and the fifth oil pipeline intersect at a position where the rod chamber of the injection cylinder 1 is located. The accumulator 3 supplies oil to the non-rod chamber of the injection cylinder 1 via the conductive fourth oil pipeline. The pressure oil in the rod chamber of the injection cylinder 1 flows back to the oil tank along the conductive fifth oil pipeline, and at this time, the oil pump 1 can pump oil to the first oil pipeline, then the first oil pipeline and the fifth oil pipeline can intersect to form an A-type half-bridge structure, thereby regulating the injection speed of the injection cylinder 1 via controlling opening degrees of the servo valves V7 and the servo valves V9.

It is to be understood that in the fast injection phase, the opening degree of the servo valve V7 is large and the opening degree of the servo valve V9 is small, so as to enable the pressure oil in the rod chamber of the injection cylinder 1 to flow back to the oil tank fast, thereby generating a faster injection speed. By conducting the first oil pipeline to form an A-type half-bridge structure in the fast injection phase, the flow rate of the rod chamber of the injection cylinder 1 can be fast adjusted by controlling the opening degree of the servo valve V9 to achieve precise control of the speed, thereby reducing or avoiding the occurrence of high-speed overshooting.

when the braking phase is carried out, the opening degree of the servo valve V7 is small and the opening degree of the servo valve V9 is large, so that the pressure in the rod chamber of the injection cylinder 1 can be increased to achieve active braking. The oil supply from the oil pump via the A-type half-bridge structure can build up the pressure in the rod chamber of the injection cylinder 1 faster to complete the active braking action with a faster acceleration to decelerate.

Figure 6:
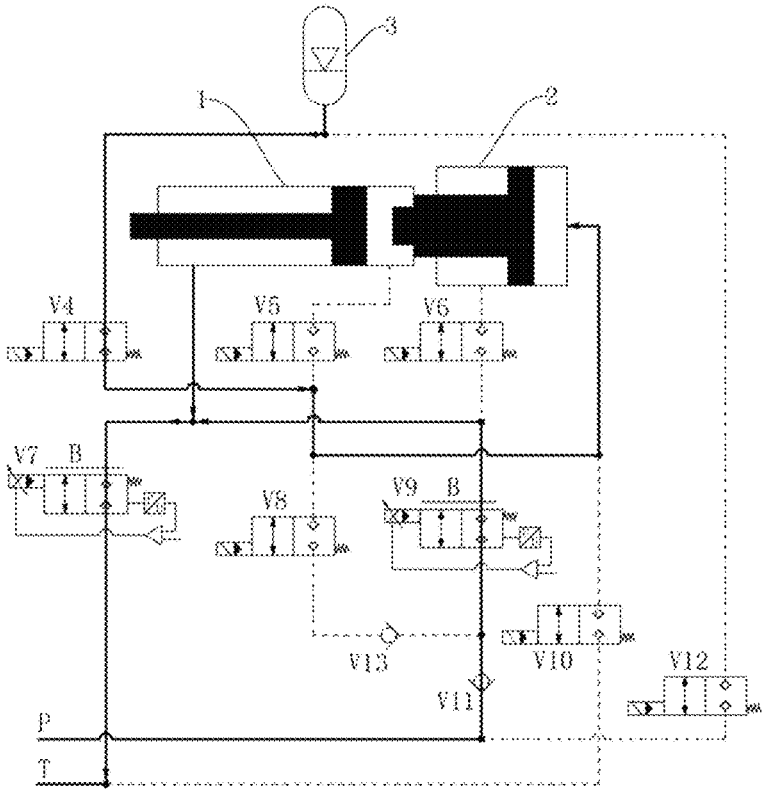
FIG. 6 is an equivalent schematic diagram of the oil pipeline in a pressurization delay phase according to the first embodiment of the present application.

Fourth, in the pressurization delay phase, i.e. the preparation phase before the start of the pressurization injection phase, as shown in FIG. 6, after the completion of the braking phase, the switching valve V5 can be closed, and the servo valves V7 and V9 can be adjusted to the preset position; at this time, the sixth oil pipeline is in the conductive state, so that the accumulator 3 can supply oil to the non-rod chamber of the pressure oil cylinder 2 via the conductive sixth oil pipeline. By carrying out the preparatory action of pressurization after the completion of the braking phase, the platform period of casting pressure can be reduced. Moreover, compared to the conventional passive closure, the present embodiment actively closes and opens the switching valve, such that the non-rod chamber of the pressurization cylinder 2 has pressure all the time, such that the speed of building up the pressure can be increased when the pressurized pressure is carried out.

Figure 12:
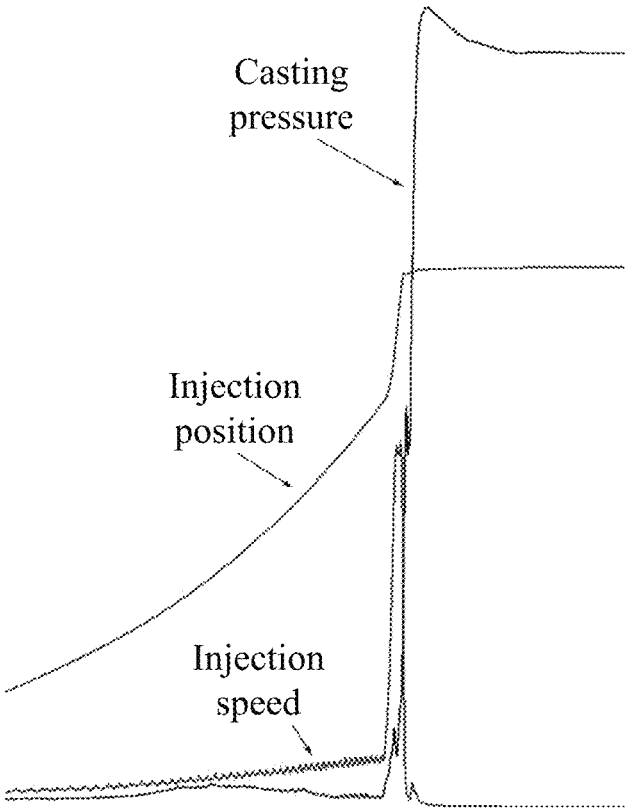
FIG. 12 is a local schematic diagram of the relationship curves of the injection position, the injection speed, and the casting pressure in the present application.
Figure 13:
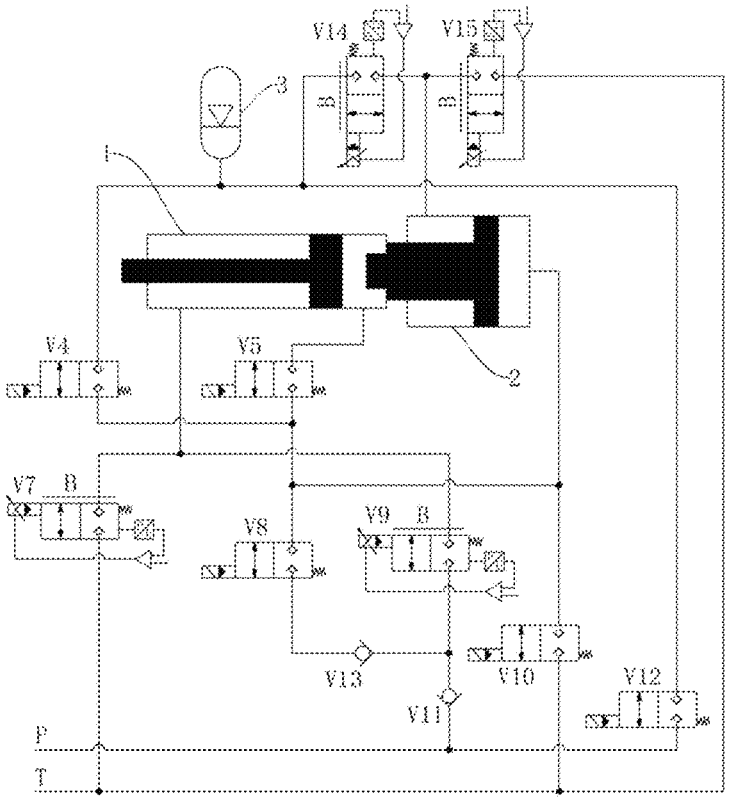
FIG. 13 is a schematic structural diagram of the oil pipeline of the injection system according to a second embodiment of the present application.

It should be known that the pressurization delay phase can be regarded as a continuation of the braking phase. The conventional injection system will proceed directly to the pressurization injection phase after the completion of the braking phase, resulting in pressure jitter in the injection system as shown by the curve in FIG. 11. However, in this embodiment, the switching valve V5 is closed to enter into the pressurization delay phase before the pressurization injection is carried out, i.e., at the moment when the braking phase is about to be completed. Since the switching valve V5 is closed with a fast speed, the braking speed can be greatly improved, such that the jitter of the casting pressure as shown in FIG. 12 can be reduced.

Figure 7:
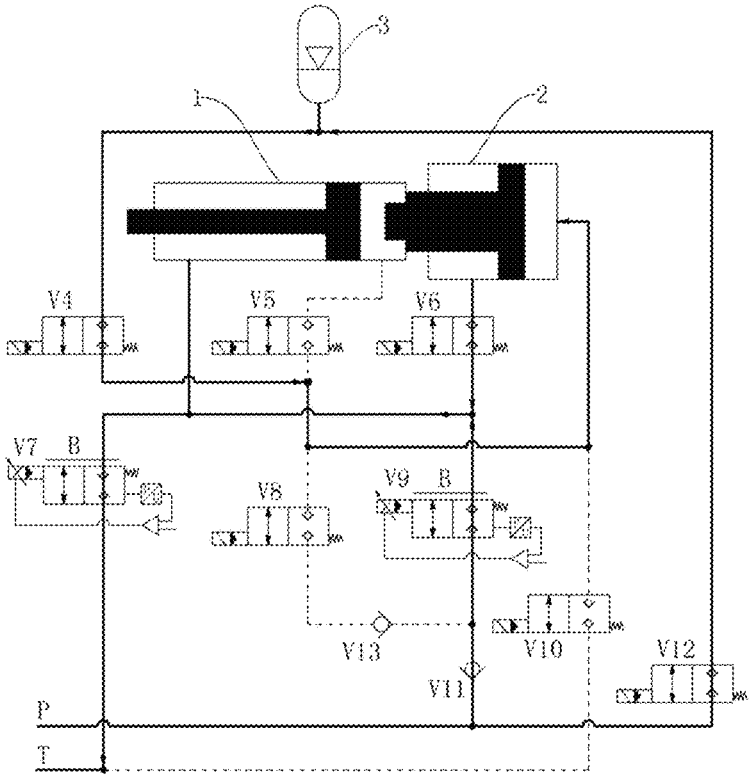
FIG. 7 is an equivalent schematic diagram of the oil pipeline in a pressurization and load phase according to the first embodiment of the present application.

Fifth, in the pressurization injection phase, as shown in FIG. 7, on the basis of the pressurization delay phase, the switching valve V6 is conducted, and at this time, the sixth oil pipeline, the seventh oil pipeline, and the eighth oil pipeline are all in the conductive state, and the seventh oil pipeline and the eighth oil pipeline are intersected between the switching valve V6 and the servo valve V9. Then the accumulator 3 can supply oil to the non-rod chamber of the pressurization cylinder 2 via the conductive sixth oil pipeline. The pressure oil in the rod chamber of the pressurization cylinder 2 flows back to the oil tank along the conductive seventh oil pipeline. The oil pump can supply oil to the conductive eighth oil pipeline to make the eighth oil pipeline and the seventh oil pipeline to be conducted via the intersecting position to form an A-type half-bridge structure, and the opening degrees of the servo valve V9 and the servo valve V7 are controlled to adjust the pressurized pressure of the pressurization cylinder 2.

It should be known that, as the servo valves V7 and V9 are both in the conductive state, the first oil pipeline and the fifth oil pipeline are correspondingly in the conductive state, such that in the process of pressurization injection, the rod chamber of the injection cylinder 1 can be replenished or discharged in accordance with the need for pressure; i.e., when the pressure of the rod chamber of the injection cylinder 1 is low, the rod chamber of the injection cylinder 1 can be replenished with oil via the first oil pipeline. When the pressure of the rod chamber of the injection cylinder 1 is high, the oil in the rod chamber of the injection cylinder 1 can be discharged via the fifth oil pipeline to reduce the pressure, such that it can avoid the loss of the control of the moving-out caused by the high pressure of the non-rod chamber of the injection cylinder 1 and the insufficient oil in the rod chamber of the injection cylinder 1 in the conventional oil pipeline when the pressurization injection is completed.

It is be appreciated that the precise control of the pressurized pressure via the A-type half-bridge structure is as follows: in the delay phase before the start of pressurization, the servo valve V7 is opened to a preset fixed opening degree and the servo valve V9 is opened to a preset fixed opening degree in order to build up the pressure in the pressurization injection phase more quickly. When the pressure of the non-rod chamber of the injection cylinder 1 reaches a certain proportion of the first preset value, the opening degree of the servo valve V7 is reduced to a certain preset value; and then the opening degree of the servo valve V9 is adjusted to change the flow rate of the servo valve V9, so that the flow rate of the servo valve V9 and the flow rate of the rod chamber of the pressurization cylinder 2 generate a pressure drop when flowing through the servo valve V7, and the pressure drop is the pressure in the rod chamber of the pressurization cylinder 2, and the pressurized pressure can be adjusted by controlling the pressure of the rod chamber of the pressurization cylinder 2. Therefore, the flow rate is controlled by adjusting the opening degree of the servo valve V9, and then the pressure drop of the servo valve V7 is controlled to control the pressurized pressure. By this control method, the pressurized pressure is adjusted with higher precision and the pressurized pressure can be adjusted from large to small, i.e., the pressurized pressure can be adjusted back after overshooting occurs.

It should also be known that when the pressurization injection is carried out, the switching valve V12 can be opened, so that the oil pump can replenish the accumulator 3 with oil via the conductive second oil pipeline. By replenishing the accumulator 3 with oil, the pressure of the accumulator 3 can be increased, thereby ensuring that the accumulator 3 has sufficient pressure in the subsequent tracking phase. At the same time, the injection cylinder 1 and the pressurization cylinder 2 share the accumulator 3, and the accumulator 3 is loaded and replenished with oil in both the pressurization injection phase and the slow injection phase, which can further reduce the volume of the accumulator 3 to reduce the cost.

Figure 8:
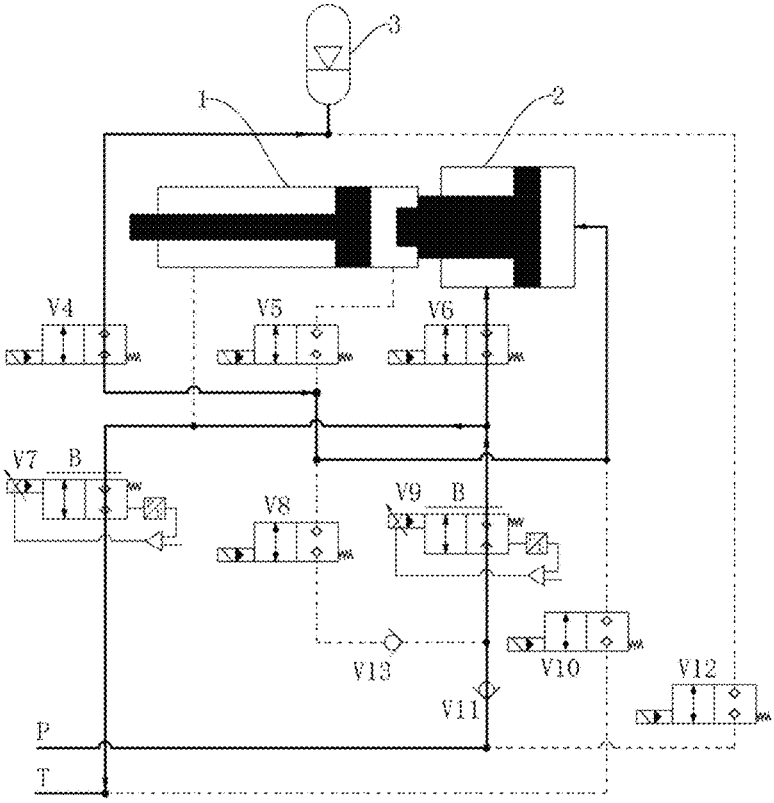
FIG. 8 is an equivalent schematic diagram of an oil pipeline in a pressure relief phase according to the first embodiment of the present application.

Sixth, in the pressure relief phase, as shown in FIG. 8, the switching valve V12 is closed to stop the oil pump from replenishing the accumulator 3 with oil, and the accumulator 3 is stopped from supplying oil to the non-rod chamber of the pressurization cylinder 2, and the opening degree of the servo valve V9 is increased and the opening degree of the servo valve V7 is reduced to allow the oil pump to supply oil to the rod chamber of the pressurization cylinder 2 via the conductive eighth oil pipeline, and then the pressurization cylinder 2 retracts and makes the pressure oil in the non-rod chamber to flow back to the non-rod chamber of the accumulator 3 along the conductive sixth oil pipeline.

It should be known that in the conventional injection system, after the pressurization injection phase is completed, the hammer head is required to cooperate in ejecting the product out from the fixed mould, and after the completion of the pressurization injection phase, due to the high pressure in the non-rod chamber of the injection cylinder 1 and the insufficient oil in the rod chamber of the injection cylinder 1, the oil compressed in the non-rod chamber of the injection cylinder 1 will push the hammer head forward in the mould opening process, result in the uncontrolled hammer head, causing the tracking to be out of control.

In this embodiment, by increasing the opening degree of the servo valve V9, the pressure of the rod chamber of the pressurization cylinder 2 can be increased to allow the pressurization cylinder 2 to be retracted, so that the pressure oil in the non-rod chamber of the pressurization cylinder 2 flows back to the accumulator 3, to actively reduce the pressure in the non-rod chamber of the injection cylinder 1, and then the pressure in the rod chamber of the injection cylinder 1 can be reduced according to the balance of forces. Of course, the pressure relief phase will not remove all of the pressure of the non-rod chamber of the injection cylinder 1, but will only reduce the pressure to the same as the system pressure to ensure that the tracking will not be out of control due to the high pressure of the non-rod chamber of the injection cylinder 1.

Figure 9:
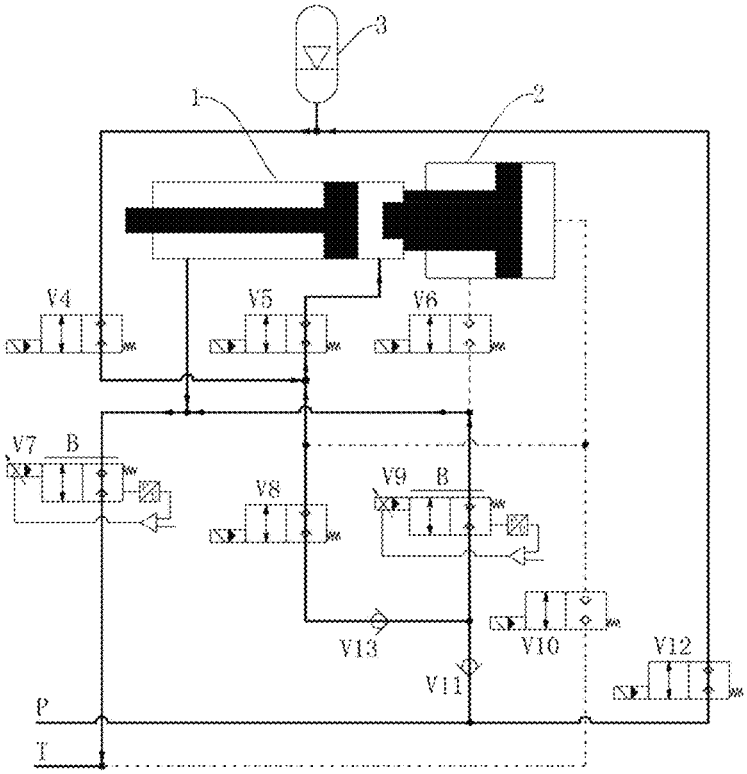
FIG. 9 is an equivalent schematic diagram of an oil pipeline in a tracking phase according to the first embodiment of the present application.

Seventh, in the tracking phase, as shown in FIG. 9, the switching valve V6 is closed, and the switching valves V5 and V12 are opened, and at this time, the second oil pipeline, the third oil pipeline, the fourth oil pipeline, and the fifth oil pipeline are in the conductive state, and the first oil pipeline and the fifth oil pipeline are intersected at a position where the rod chamber of the injection cylinder 1 is connected. The oil pump and the accumulator 3 supply oil to the non-rod chamber of the injection cylinder 1 via the conductive third oil pipeline and the conductive fourth oil pipeline, respectively. The oil pump also replenishes the accumulator 3 with oil via the second oil pipeline. The pressure oil in the rod chamber of the injection cylinder 1 flows back to the oil tank along the conductive fifth oil pipeline, and the oil pump may supply oil to the conductive first oil pipeline, to make the first oil pipeline to be conductive with the fifth oil pipeline via the intersecting position to form an A-type half-bridge structure, and the injection speed of the injection cylinder 1 is adjusted by controlling the opening degrees of the servo valve V7 and the servo valve V9.

Specifically, after the completion of the pressure relief phase, the speed of moving-out of the hammer head can be controlled by increasing the opening degree of the servo valve V7 and decreasing the opening degree of the servo valve V9. The replenishment of the accumulator 3 with oil by the oil pump can increase the moving-out pressure.

Figure 10:
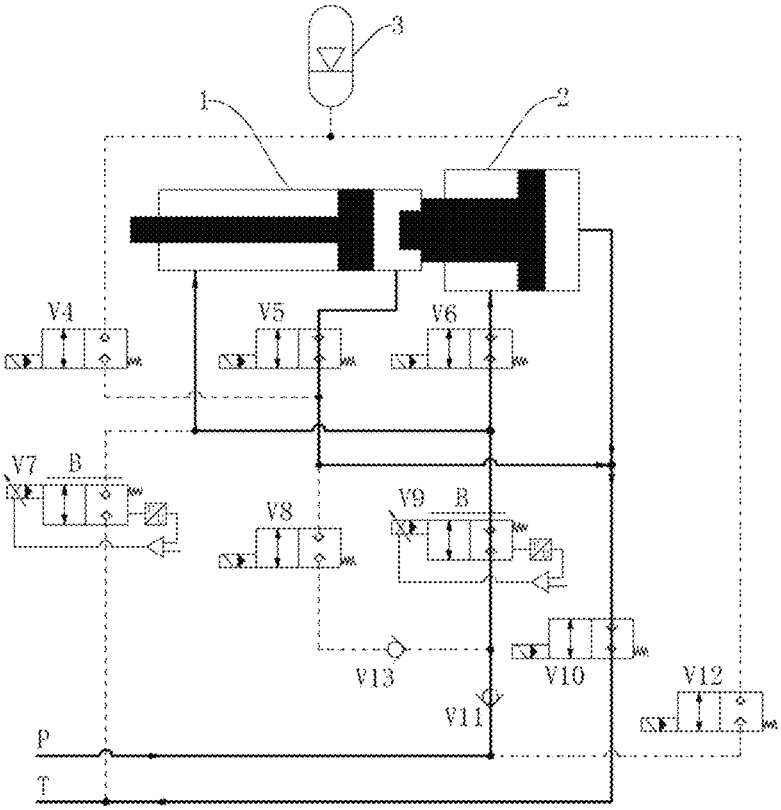
FIG. 10 is an equivalent schematic diagram of an oil pipeline in a hammer back phase according to the first embodiment of the present application.
Figure 11:
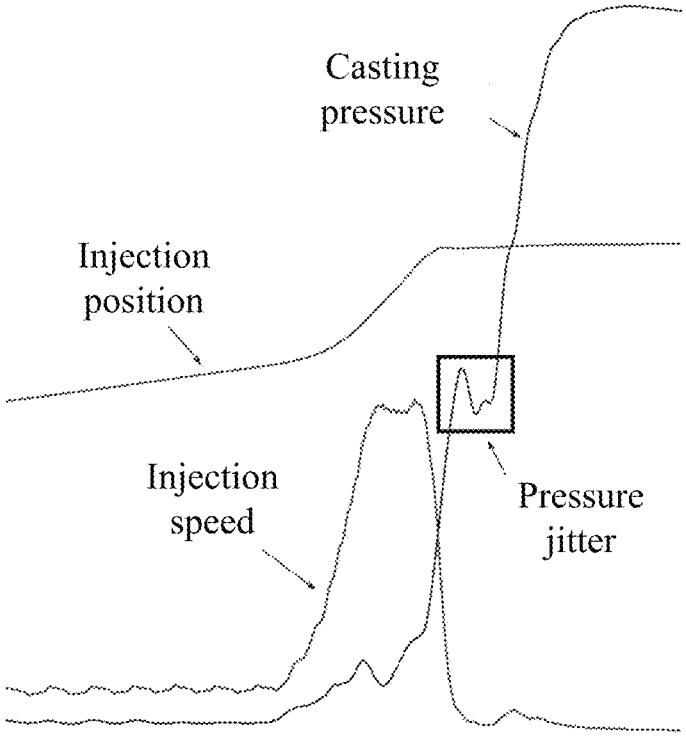
FIG. 11 is a local schematic diagram of relationship curves of the injection position, the injection speed, and the casting pressure in a conventional injection system.

Eighth, in the hammer return phase, as shown in FIG. 10, the switching valve V4, the switching valve V8, the switching valve V12, and the servo valve V7 are closed, and the switching valve V10 is opened, and at this time, the first oil pipeline, the eighth oil pipeline, the ninth oil pipeline, and the tenth oil pipeline are in the conductive state. The oil pump supplies oil to the rod chamber of the injection cylinder 1 and the rod chamber of the pressurization cylinder 2 via the first oil pipeline and the eighth oil pipeline, respectively, and the non-rod chamber of the injection cylinder 1 and the non-rod chamber of the pressurization cylinder 2 make the pressure oil to flow back to the oil tank via the conductive tenth oil pipeline and the conductive ninth oil pipeline, respectively.

It should be known that by simultaneously supplying oil to the rod chamber of the injection cylinder 1 and the rod chamber of the pressurization cylinder 2 in the hammer return phase, the risk of dry grinding of the rod chambers in the conventional injection system in the hammer return phase can be avoided.

In this embodiment, the same servo valve V9 is used in the slow injection phase, the fast injection phase, the pressurization injection phase, the tracking phase, and the hammer return phase, and the same servo valves V7 and V9 are used in the fast injection phase, the pressurization injection phase, and the tracking phase, i.e., only two servo valves are used in the whole injection system, which can effectively reduce the cost of the injection system.

Second Embodiment

Compared to the first embodiment, the difference between the first embodiment and the second embodiment is that two servo valves V14 and V15 are added, while the switching valve V6 is deleted. Specifically, as shown in FIGS. 13 to 22, the valve module includes the switching valves V4, V5, V8, V10, and V12, the servo valves V7, V9, V14, and V15, and the un-directional valves V11 and V13. The output end of the oil pump is connected to the rod chamber of the injection cylinder 1 via the un-directional valve V11 and the servo valve V9 connected in series in sequence to form the first oil pipeline. The output end of the oil pump is connected to the accumulator 3 via the switching valve V12 to form a second oil pipeline; and the output end of the oil pump is connected to the non-rod chamber of the injection cylinder 1 via the un-directional valve V11, the un-directional valve V13, the switching valve V8 and the switching valve V5 connected in series in sequence to form the third oil pipeline. The accumulator 3 is connected to the non-rod chamber of the injection cylinder 1 via the switching valve V4 and switching valve V5 connected in series in sequence to form the fourth oil pipeline; the oil tank is connected to the rod chamber of the injection cylinder 1 via the servo valve V7 to form the fifth oil pipeline. The accumulator 3 is connected to the non-rod chamber of the pressurization cylinder 2 via the switching valve V4 to form the sixth oil pipeline. The oil tank is connected to the non-rod chamber of the pressurization cylinder 2 via the switching valve V10 to form the ninth oil pipeline. The oil tank is connected to the non-rod chamber of the injection cylinder 1 via the switching valves V10 and V5 connected in series in sequence to form the tenth oil pipeline. The accumulator 3 is connected to the rod chamber of the pressurization cylinder 2 via the servo valve V14 to form the eleventh oil pipeline. The oil tank is connected to the rod chamber of the pressurization cylinder 2 via the servo valve V15 to form the twelfth oil pipeline. The oil pump is connected to the rod chamber of the pressurization cylinder 2 via the switching valve V12 and the servo valve V14 connected in series in sequence to form the thirteenth oil pipeline.

The whole injection process of the injection system in this embodiment can still be sequentially divided into an energy storage phase, a slow injection phase, a fast injection phase, a braking phase, a pressurization delay phase, a pressurization injection phase, a pressure relief phase, a tracking phase, and a hammer return phase. For the sake of understanding, the specific work process of each phase can be described in detail below.

Figure 14:
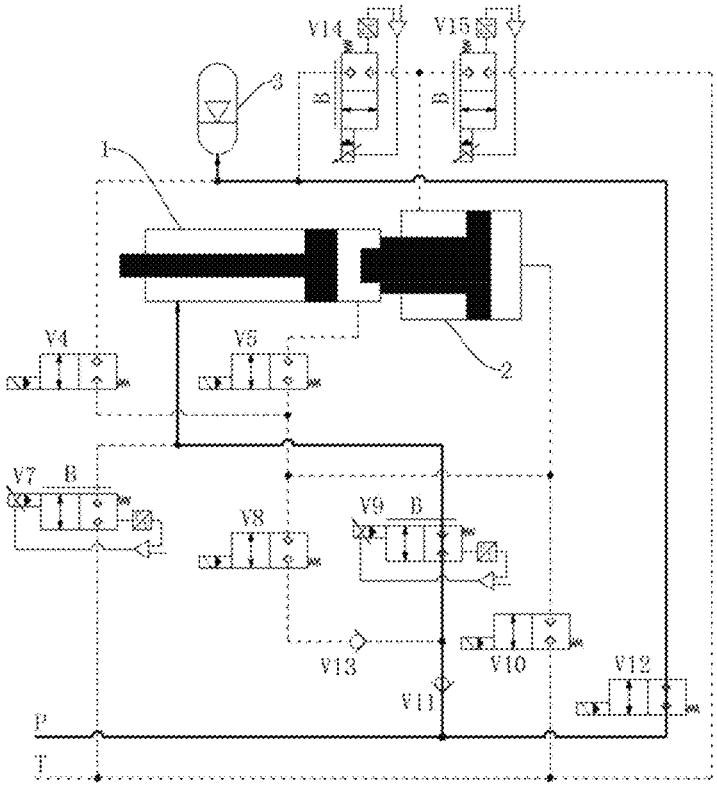
FIG. 14 is an equivalent schematic diagram of the oil pipeline in the energy storage phase according to the second embodiment of the present application.

First, in the energy storage phase, as shown in FIG. 14, the equivalent oil pipeline structure in this embodiment is the same as the equivalent oil pipeline structure shown in FIG. 2 in first embodiment; therefore, a detailed description is not carried out here, and a specific reference can be made to the energy storage phase of the first embodiment described above.

Figure 15:
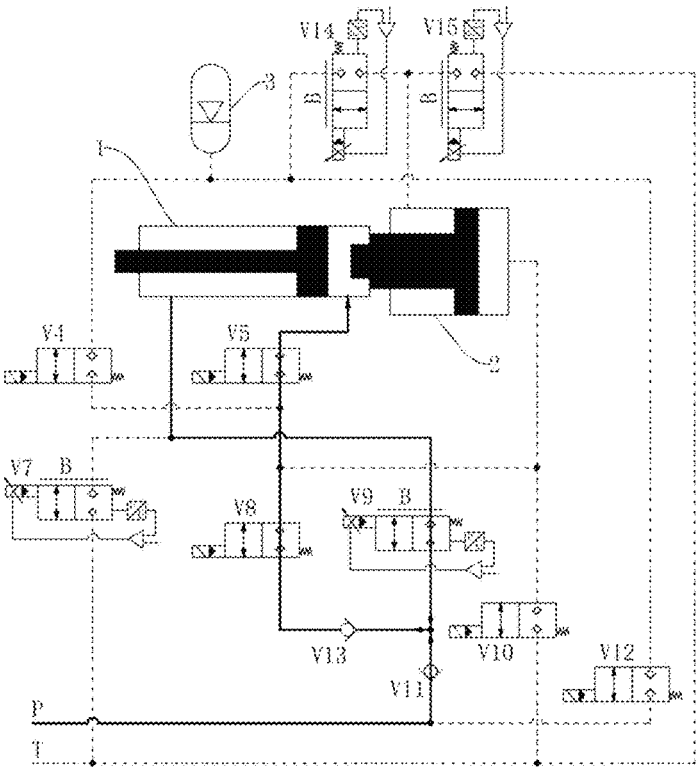
FIG. 15 is an equivalent schematic diagram of the oil pipeline when a slow injection phase is carried out alone by the oil pump according to the second embodiment of the present application.
Figure 16:
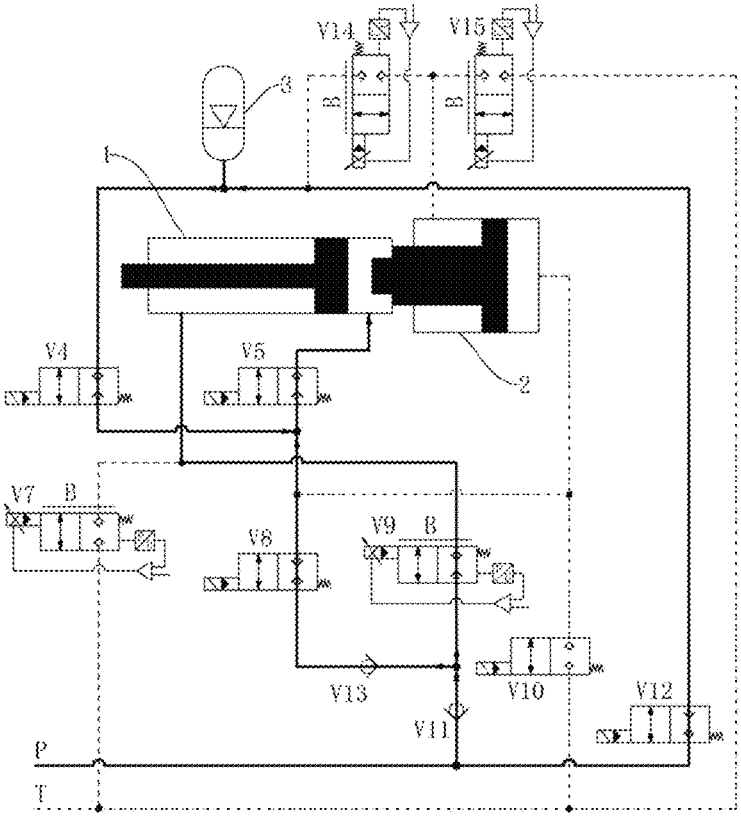
FIG. 16 is an equivalent schematic diagram of the oil pipeline when the slow injection phase is carried out by a collaboration of the oil pump and the accumulator according to the second embodiment of the present application.

Second, in the slow injection phase, as shown in FIGS. 15 and 16, the equivalent oil pipeline structure in this embodiment is the same as the equivalent oil pipeline structure shown in FIGS. 3 and 4 in the first embodiment; therefore, a detailed description will not be carried out here, and a specific reference may be made to the slow injection phase of the first embodiment described above.

Figure 17:
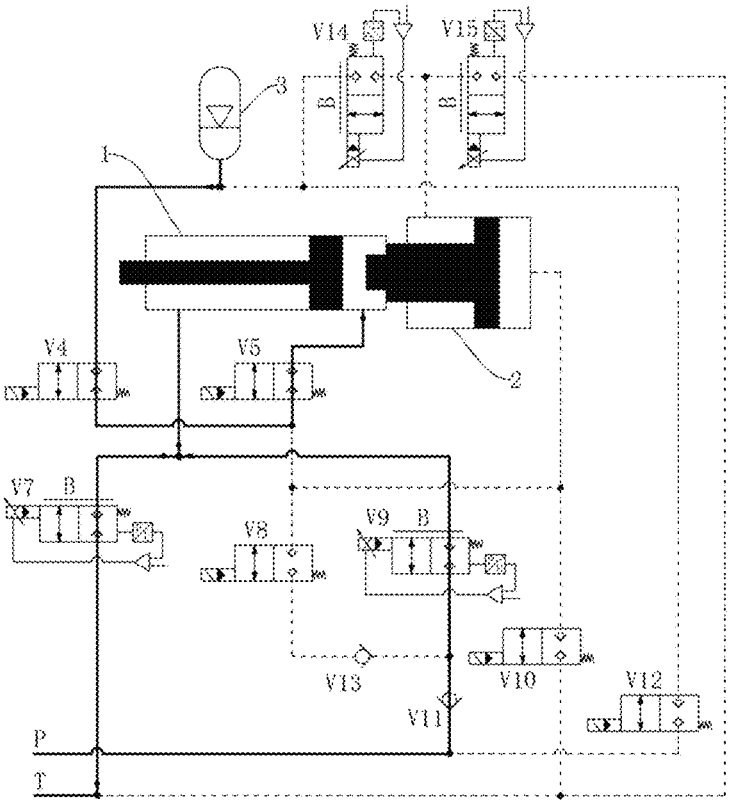
FIG. 17 is an equivalent schematic diagram of the oil pipeline in the fast injection phase and the braking phase according to the second embodiment of the present application.

Third, in the fast injection phase and the braking phase, as shown in FIG. 17, the equivalent oil pipeline structure in this embodiment is the same as that shown in FIG. 5 in first embodiment; therefore, a detailed description is not carried out here, and a specific reference can be made to the fast injection phase and the braking phase of the first embodiment described above.

Figure 18:
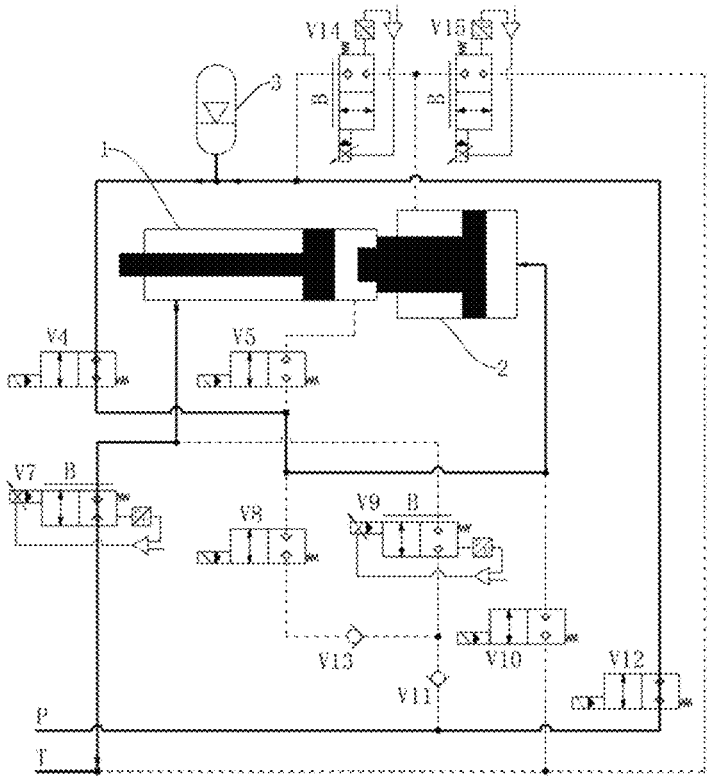
FIG. 18 is an equivalent schematic diagram of the oil pipeline in the pressurization delay phase according to the second embodiment of the present application.

Fourth, the pressurization delay phase, i.e., the preparation phase before the pressurization injection phase begins, as shown in FIG. 18, after the completion of the braking phase, the switching valve V5 and the servo valve V9 can be closed, and the switching valve V12 is opened; at this time, the second oil pipeline, the fifth oil pipeline, and the sixth oil pipeline are in the conductive state. By performing the preparation action of pressurization after the completion of the braking phase, the platform period of casting pressure can be reduced.

Figure 19:
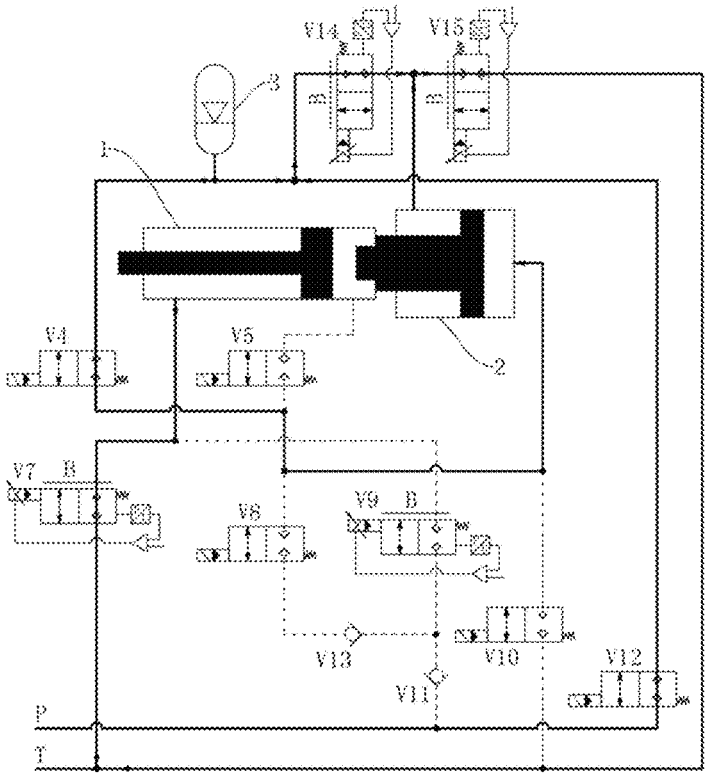
FIG. 19 is an equivalent schematic diagram of the oil pipeline in the pressurization and load phase according to the second embodiment of the present application.

Fifth, in the pressurization injection phase, as shown in FIG. 19, on the basis of the pressurization delay phase, servo valves V14 and V15 are opened; at this time, the second oil pipeline, the fifth oil pipeline, the sixth oil pipeline, the eleventh oil pipeline, and the twelfth oil pipeline are conducted, and the eleventh oil pipeline and the twelfth oil pipeline intersect to be conducted at the rod chamber of the pressurization cylinder 2. Then the accumulator 3 supplies oil to the non-rod chamber of the pressurization cylinder 2 via the conductive sixth oil pipeline. The pressure oil in the rod chamber of the injection cylinder 1 flows back to the oil tank along the conductive fifth oil pipeline, and the accumulator 3 supplies oil to the conductive eleventh oil pipeline, the rod chamber of the pressurization cylinder 2 discharges oil via the conductive twelfth oil pipeline to make the eleventh and twelfth oil pipeline to be conducted at the intersecting position to form the A-type half-bridge structure, and then the pressurized pressure of the pressurization cylinder 2 is adjusted by controlling the opening degrees of the servo valves V14 and V15.

It should be noted that the precise control of the pressurized pressure by the A-type half-bridge structure is as follows: the servo valve V7 is opened to a preset fixed opening degree, and the servo valves V14 and V15 are also opened to a preset fixed opening degree. When the pressure of the non-rod chamber of the injection cylinder 1 reaches a certain proportion of the first preset value, the opening degree of the servo valve V15 is reduced to a certain preset value; then the opening degree of the servo valve V14 is adjusted in order to change the flow rate of the servo valve V14, so that the flow rate of the servo valve V14 and the flow rate of the rod chamber of the pressurization cylinder 2 will produce a pressure drop when flowing through the servo valve V15, and the pressure drop is the pressure of the rod chamber of pressurization cylinder 2, and the pressurized pressure can be adjusted by controlling the pressure of the rod chamber of the pressurization cylinder 2. Therefore, the flow rate can be controlled by adjusting the opening degree of the servo valve V14, and then the pressure drop of the servo valve V15 can be controlled to control the pressurized pressure. By this control method, the pressurized pressure is adjusted with higher precision and the pressurized pressure can be adjusted from large to small, i.e., the pressurized pressure can be adjusted back after overshooting occurs.

It should also be known that, in the process of pressurization, the switching valve V12 can also be opened to make the second oil pipeline to be conducted, so that the oil pump can replenish the accumulator 3 with oil via the second oil pipeline, so as to ensure that the accumulator 3 has a sufficient pressure in the pressurization process.

Figure 20:
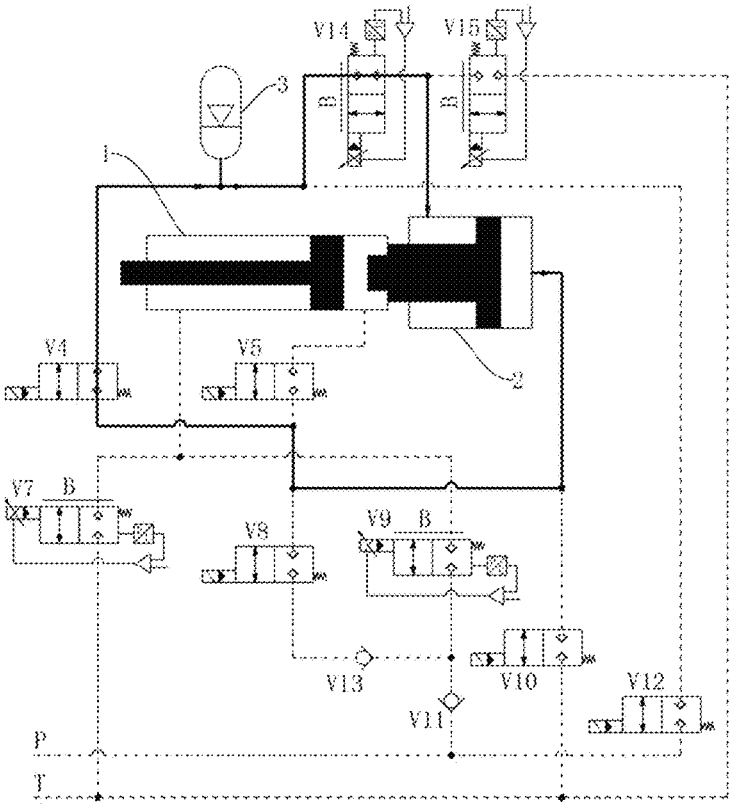
FIG. 20 is an equivalent schematic diagram of an oil pipeline in a pressure relief phase according to the second embodiment of the present application.

Sixth, in the pressure relief phase, as shown in FIG. 20, after the completion of the pressurization injection phase, the switching valve V12 is closed, and the servo valves V7 and V15 are closed simultaneously, so as to cut off the second oil pipeline, the fifth oil pipeline, and the twelfth oil pipeline; and the accumulator 3 is stopped from supplying oil via the sixth oil pipeline to the non-rod chamber of the pressurization cylinder 2, but the sixth and eleventh oil pipelines remain conductive. The accumulator 3 can supply oil to the rod chamber of the pressurization cylinder 2 via the conductive eleventh oil pipeline, such that the pressurization cylinder 2 retracts and makes the pressure oil in the non-rod chamber to flow back to the accumulator 3 along the sixth oil pipeline. At this time, the pressure in the non-rod chamber of the injection cylinder 1 will be reduced, but it will not remove all the pressure in the non-rod chamber of the injection cylinder 1 in the pressure relief phase, but will only reduce the pressure to the same as the system pressure to ensure that there is no loss of control of tracking due to high pressure in the non-rod chamber.

Figure 21:
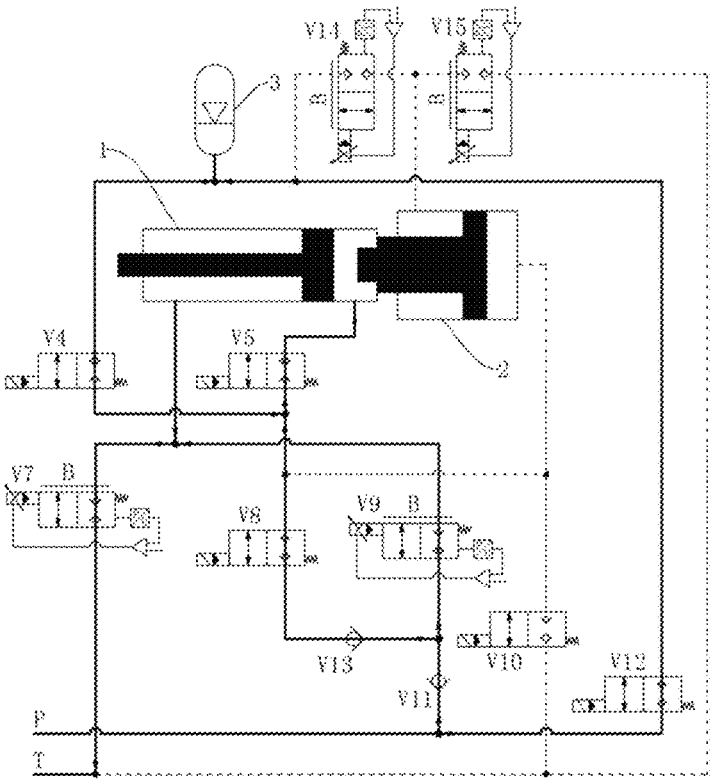
FIG. 21 is an equivalent schematic diagram of an oil pipeline in a tracking phase according to the second embodiment of the present application.

Seventh, in the tracking phase, as shown in FIG. 21, the equivalent oil pipeline structure in this embodiment is the same as the equivalent oil pipeline structure shown in FIG. 9 in first embodiment; therefore, a detailed description will not be carried out here, and a specific reference can be made to the tracking phase of the first embodiment described above.

Figure 22:
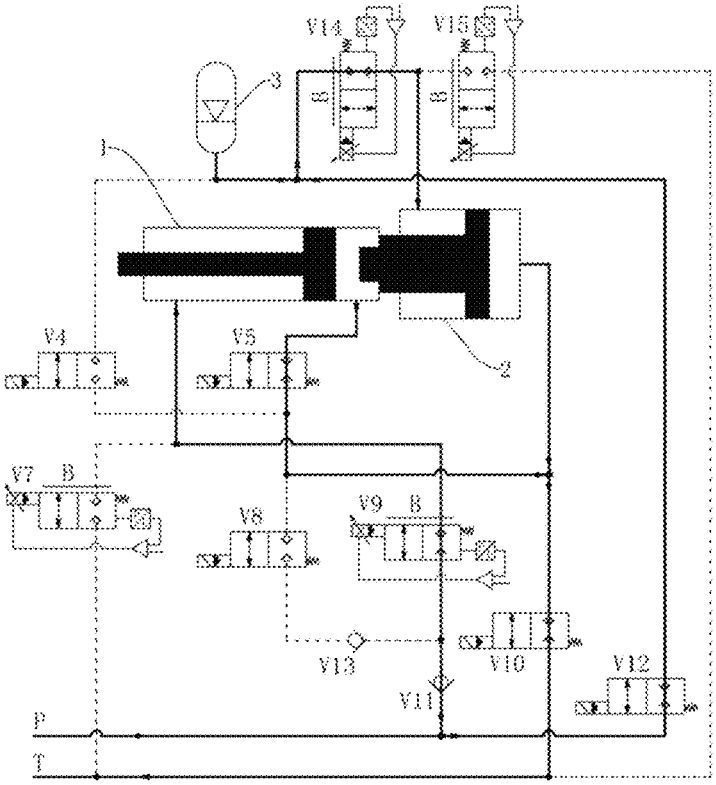
FIG. 22 is an equivalent schematic diagram of the oil pipeline in the hammer back phase according to the second embodiment of the present application.

Eighth, in the hammer back phase, as shown in FIG. 22, after the completion of the tracking phase, the switching valves V4 and V8 and the servo valve V7 are closed, while the servo valve V14 is opened. At this time, the first oil pipeline, the second oil pipeline, the ninth oil pipeline, the tenth oil pipeline and the thirteenth oil pipeline are conducted. The oil pump can supply oil to the rod chamber of the injection cylinder 1 and the pressurization cylinder 2 via the first oil pipeline and the thirteenth oil pipeline, respectively, and at this time, the oil pump can also replenish the accumulator 3 with oil via the conductive second oil pipeline, so as to shorten the time of the energy storage phase in the next injection process; and the non-rod chambers of the injection cylinder 1 and the pressurization cylinder 2 make the pressure oil to flow back to the oil tank via the tenth oil pipeline and the ninth oil pipeline, respectively.

The above describes the basic principle, the main features and the advantages of the present application. It should be understood by those skilled in the art that the present application is not limited by the above embodiments, and that the above embodiments and the description in the specification are only the principles of the present application, and that there are various changes and improvements in the present application without departing from the scope of the present application, and that all these changes and improvements fall within the scope protected by the present application. The scope protected by the present application herein is defined by the appended claims and equivalents thereof.

What is claimed is:

1. An injection system for a die casting machine, comprising an accumulator, an injection cylinder, a pressurization cylinder and a valve module connected via an oil pipeline;

wherein in a slow injection phase of the injection cylinder, the valve module is adapted for dynamic switching between a phase of an oil pump of the oil pipeline supplying oil alone and a phase of the oil pump and the accumulator jointly supplying oil;

in a fast injection phase, a braking phase and a tracking phase, the valve module is configured to make a rod chamber of the injection cylinder to be conductive with the oil pump of the oil pipeline and an oil tank, to form a first A-type half-bridge structure; and in a pressurization injection phase, the valve module is configured to make a rod chamber of the pressurization cylinder to be conductive with the oil pump of the oil pipeline and the oil tank to form a second A-type half-bridge structure;

wherein the valve module comprises a switching valve V4, a switching valve V5, a switching valve V6, a switching valve V8, a switching valve V12, a servo valve 7, a servo valve V9 and a unidirectional valve V11 and a unidirectional valve V13;

an output end of the oil pump is connected to the rod chamber of the injection cylinder via the unidirectional valve V11 and the servo valve V9 connected in series in sequence to form a first oil pipeline;

the output of the oil pump is connected to the accumulator via the switching valve V12 to form a second oil pipeline;

the output of the oil pump is connected to a non-rod chamber of the injection cylinder via the unidirectional valve V11, the unidirectional valve V13, the switching valve V8 and the switching valve V5 connected in series in sequence to form a third oil pipeline; and the accumulator is connected to the non-rod chamber of the injection cylinder via the switching valve V4 and the switching valve V5 connected in series in sequence to form a fourth oil pipeline;

the oil tank is connected to the rod chamber of the injection cylinder via the servo valve V7 to form a fifth oil pipeline;

the accumulator is connected to a non-rod chamber of the pressurization cylinder via the switching valve V4 to form a sixth oil pipeline;

the output of the oil pump is connected to the rod chamber of the pressurization cylinder via the unidirectional valve V11, the servo valve V9 and the switching valve V6 connected in series in turn to form an eighth oil pipeline;

in the fast injection phase and the braking phase, the accumulator supplies oil to the non-rod chamber of the injection cylinder via the fourth oil pipeline that is conductive, and pressure oil in the rod chamber of the injection cylinder flows back to the oil tank along the fifth oil pipeline that is conductive; and the first oil pipeline and the fifth oil pipeline are conducted to form a third A-type half-bridge structure, and opening degrees of the servo valve V7 and the servo valve V9 are controlled to regulate an injection speed of the injection cylinder;

in the tracking phase, the oil pump and the accumulator supply oil to the non-rod chamber of the injection cylinder via the third oil pipeline that is conductive and the conductive fourth oil pipeline, respectively; the oil pump further replenishes the accumulator with oil via the second oil pipeline; and the pressure oil in the rod chamber of the injection cylinder flows back to the oil tank along the fifth oil pipeline; and the first oil pipeline and the fifth oil pipeline are conducted to form a fourth A-type half-bridge structure, and opening degrees of the servo valve V7 and the servo valve V9 are controlled to regulate the injection speed of the injection cylinder;

the oil tank is connected to the rod chamber of the pressurization cylinder via the servo valve V7 and the switching valve V6 connected in series in sequence to form a seventh oil pipeline;

in the pressurization injection phase, the accumulator supplies oil to the non-rod chamber of the pressurization cylinder via the sixth oil pipeline that is conductive; the pressure oil in the rod chamber of the injection cylinder and in the rod chamber of the pressurization cylinder flows back to the oil tank along the seventh oil pipeline and the fifth oil pipeline that are conducive; and the eighth oil pipeline and the seventh oil pipeline are conducted to form a fifth A-type half-bridge structure, and the opening degrees of the servo valve V9 and the servo valve V7 are controlled to regulate a pressurized pressure of the pressurization cylinder.

2. The injection system for the die casting machine according to claim 1, wherein in the phase of the oil pump supplying oil alone in the slow injection phase, the oil pump supplies oil to the non-rod chamber of the injection cylinder via the third oil pipeline that is conductive, and the first oil pipeline forms a differential loop with the third oil pipeline.

3. The injection system for the die casting machine according to claim 2, wherein in the phase of the oil pump and the accumulator jointly supplying oil in the slow injection phase, the accumulator supplies oil to the non-rod chamber of the injection cylinder via the conductive fourth oil pipeline on a basis of the oil pump supplying oil alone.

4. The injection system for the die casting machine according to claim 1, wherein when pressure relief is carried out after a completion of the pressurization injection phase, oil is stopped supplying from the accumulator to the non-rod chamber of the pressurization cylinder, and the opening degree of the servo valve V9 is increased and the opening degree of the servo valve V7 is decreased to allow the oil pump to supply oil to the rod chamber of the pressurization cylinder via the eighth oil pipeline that is conductive, thereby the pressurization cylinder retracting to make the pressure oil in the non-rod chamber of the pressurization cylinder to flow back to the accumulator along the conductive sixth oil pipeline.

5. The injection system for the die casting machine according to claim 1, wherein the valve module further comprises a switching valve V10;

the oil tank is connected to the non-rod chamber of the pressurization cylinder via the switching valve V10 to form a ninth oil pipeline; and the oil tank is connected to the non-rod chamber of the injection cylinder via the switching valve V10 and the switching valve V5 connected in series in sequence to form a tenth oil pipeline;

in a hammer return phase after a completion of the tracking phase, the oil pump supplies oil to the rod chamber of the injection cylinder and the rod chamber of the pressurization cylinder via the first oil pipeline and the eighth oil pipeline that are conductive, respectively; and the non-rod chamber of the injection cylinder and the non-rod chamber of the pressurization cylinder make the pressure oil to flow back to the oil tank via the tenth oil pipeline and the ninth oil pipeline that are conductive, respectively.

* * * * *